US008933379B2

(12) United States Patent
Challita et al.

(10) Patent No.: US 8,933,379 B2
(45) Date of Patent: Jan. 13, 2015

(54) STAND-UP MEMBRANE ROOFING INDUCTION HEATING TOOL

(71) Applicant: OMG, Inc., Agawam, MA (US)

(72) Inventors: Antonios Challita, Bellbrook, OH (US); John P. Barber, Dayton, OH (US); Joshua S. Kelly, Longmeadow, MA (US)

(73) Assignee: OMG, Inc., Agawam, MA (US)

( * ) Notice: Subject to any disclaimer, the term of this patent is extended or adjusted under 35 U.S.C. 154(b) by 0 days.

(21) Appl. No.: 13/947,438

(22) Filed: Jul. 22, 2013

(65) Prior Publication Data

US 2013/0299488 A1 Nov. 14, 2013

Related U.S. Application Data

(60) Division of application No. 12/147,917, filed on Jun. 27, 2008, now Pat. No. 8,492,683, which is a continuation-in-part of application No. 29/303,803, filed on Feb. 18, 2008, now abandoned.

(51) Int. Cl.

| | |
|---|---|
| ***H05B 6/00*** | (2006.01) |
| ***H05B 6/10*** | (2006.01) |
| ***E04D 15/04*** | (2006.01) |

(52) U.S. Cl.

CPC ..... *H05B 6/101* (2013.01); *H05B 6/105* (2013.01); *E04D 15/04* (2013.01)

USPC ..... 219/618

(58) Field of Classification Search

None

See application file for complete search history.

(56) References Cited

U.S. PATENT DOCUMENTS

| | | | | |
|---|---|---|---|---|
| 4,546,589 | A | 10/1985 | Seaman | |
| 4,743,332 | A * | 5/1988 | Black | 156/359 |
| 4,841,706 | A | 6/1989 | Resan | |
| 4,845,590 | A * | 7/1989 | Mikolajczak | 361/720 |
| 4,894,112 | A | 1/1990 | Lippman | |

(Continued)

FOREIGN PATENT DOCUMENTS

| | | |
|---|---|---|
| EP | 0735210 A1 | 10/1996 |
| EP | 0884609 A1 | 12/1998 |

(Continued)

OTHER PUBLICATIONS

International Search Report, PCT/US2006/009973, Aug. 24, 2006.

(Continued)

*Primary Examiner* — Kurt Fernstrom
*Assistant Examiner* — Dolores Collins
(74) *Attorney, Agent, or Firm* — Alix, Yale & Ristas, LLP

(57) ABSTRACT

A portable induction heating tool is provided as a membrane roofing tool for use in sealing anchor plates with a heat-activated adhesive to a membrane roofing member. The tool uses two different audible tones so two tools can be used simultaneously on a single roof, while allowing a user to easily distinguish between the operation of both tools. The main housing containing electronics is weather-tight, and requires no forced-cooling devices. The controller automatically performs data logging functions, such as counting the number of anchor plates per job or per day that have been properly placed, counting the number of activation events for a tool's life, tracking the number of faults which occur as the tool is being used, and the controller can identify the type of fault that occurs during operation of the tool. The controller also stores energy setting changes in memory.

13 Claims, 10 Drawing Sheets

(56) References Cited

U.S. PATENT DOCUMENTS

| | | | | |
|---|---|---|---|---|
| 4,913,772 | A | 4/1990 | Taylor et al. | |
| 5,624,511 | A | 4/1997 | Lippman | |
| 5,942,259 | A * | 8/1999 | Uchiyama et al. | 425/174.8 R |
| 6,023,906 | A | 2/2000 | Folkersen | |
| 6,229,127 | B1 * | 5/2001 | Link | 219/635 |
| 6,238,502 | B1 | 5/2001 | Hubbard | |
| 6,382,954 | B1 * | 5/2002 | Mai | 425/445 |
| 6,536,498 | B1 | 3/2003 | Srinivasan et al. | |
| 6,588,475 | B1 | 7/2003 | Simon, Jr. et al. | |
| 7,399,949 | B2 * | 7/2008 | Barber et al. | 219/621 |
| 2004/0048537 | A1 | 3/2004 | Holzer et al. | |
| 2008/0029507 | A1 * | 2/2008 | Barber et al. | 219/633 |

FOREIGN PATENT DOCUMENTS

| | | | |
|---|---|---|---|
| GB | 2325982 | A | 12/1998 |
| JP | 1200937 | A2 | 8/1989 |
| WO | 2006104740 | A1 | 10/2006 |
| WO | 2008010833 | A1 | 1/2008 |

OTHER PUBLICATIONS

International Search Report, PCT/US2006/046172, May 29, 2007.

International Preliminary Report on Patentability, PCT/US2006/009973, Oct. 11, 2007.

* cited by examiner

STAND-UP MEMBRANE ROOFING INDUCTION HEATING TOOL

CROSS-REFERENCE TO RELATED APPLICATIONS

This application is a divisional of U.S. patent application Ser. No. 12/147,917, filed Jun. 27, 2008, for "STAND-UP MEMBRANE ROOFING INDUCTION HEATING TOOL," which claims priority to U.S. Design patent application No. 29/303,803, filed Feb. 18, 2008 for "PORTABLE INDUCTION HEATER," the contents of which are incorporated herein by reference in their entireties.

BACKGROUND

The disclosure relates generally to induction heating equipment and is particularly directed to a portable induction heating tool of the type which is used to seal anchor plates with a heat-activated adhesive to a membrane roofing member. Specifically disclosed is a membrane roofing tool that uses two different audible tones so two tools can be used simultaneously on a single roof, while allowing a user to easily distinguish between the operation of both tools. Also disclosed is an induction heating tool that uses no forced cooling, in which all of the electronics are cooled strictly by natural air convection cooling. Also disclosed is a membrane roofing tool which contains a controller that automatically counts the number of anchor plates for a jobsite, automatically counts the number of activation events for a tool's life, and keeps track of the number of faults which occur as the tool is being used; in addition, the tool has a controller that performs data logging functions, such as the number of anchor plates per job or per day that have been properly placed, and can also store energy setting changes or other tool operational attribute changes in a memory; moreover, the controller of the tool can identify the type of fault that occurs during operation of the tool, and can record the number of faults on a particular day and store it in a log.

Induction heating devices have been available for use with membrane roofs in the past. One such device is described in U.S. Pat. No. 6,229,127. The induction heating device in this patent used four sensing coils with indicators to help the user find the correct position of the induction tool over one of the attachment disks that is to be heated by the induction coil of the tool. This conventional tool was fairly small in height, and the user had to generally be in a kneeling position to use it.

Another conventional heating device for use with membrane roofs is described in U.S. Pat. No. 4,743,332. This invention "pre-heats" the membrane roofing material, and has a rather large enclosure that sucks air through louvers to cool the electronics. Moreover, this device is a rolling device, and is not so much a portable device that could be lifted and placed over an anchor plate beneath the membrane layer being sealed.

SUMMARY

Accordingly, it is an advantage of the disclosed membrane roofing tool to incorporate two different audible tones so two tools can be used simultaneously on a single roof, while allowing a user to easily distinguish between the operation of both tools.

It is an advantage of an induction heating tool that uses no forced cooling so all of the electronics are cooled strictly by natural air convection cooling.

It is an advantage to provide an induction heating tool for use in membrane roofing in which the tool contains a controller that automatically counts the number of anchor plates for a jobsite, the tool automatically counts the number of activation events for a tool's life, and the tool keeps track of the number of faults which occur as the tool is being used.

It is another advantage to provide an induction heating tool for use in membrane roofing in which the tool has a controller that performs data logging functions, such as the number of anchor plates per job or per day that have been properly placed, and can also store energy setting changes or other tool operational attribute changes in a memory.

It is a further advantage of the tool in which the controller can identify the type of fault that occurs during operation of the tool, and can record the number of faults on a particular day and store it in a log in a memory element.

Additional advantages and other novel features of the tool and method will be set forth in part in the description that follows and in part will become apparent to those skilled in the art upon examination of the following or may be learned with the practice of the invention.

To achieve the foregoing and other advantages, and in accordance with one aspect of the present invention, an induction heating apparatus is provided, which comprises: (a) a lower base portion; (b) a body portion that is spaced-apart from the lower base portion; (c) a support member that mechanically holds the lower base portion and the body portion in the spaced-apart orientation; (d) a handle portion that is mechanically attached to a upper area of the body portion; (e) an electrical power supply and a controller, located in an interior space of the body portion; and (f) an induction coil located in the base portion; wherein: (g) the lower base portion exhibits a predetermined footprint area, and the induction heating apparatus exhibits a sufficiently low center of gravity, which allows the induction heating apparatus to be placed on sloped surfaces without tipping over; (h) the body portion includes a housing that is substantially liquid-tight in construction, such that it may be left outdoors without incurring damage due to wet weather; and (i) the body portion has a plurality of heat sink elements that are positioned on a portion of a surface of the housing of the body portion to dissipate thermal energy from interior space of the body portion, without the use of any forced cooling mechanism.

In another embodiment, an induction heating apparatus is provided, which comprises: (a) a lower base portion; (b) a middle body portion; (c) a handle portion that is mechanically attached to a upper area of the body portion; (d) an electrical power supply, a coil driver circuit, and a controller, located in one of the body portion and the lower base portion, wherein the controller includes a processing circuit and a memory circuit; (e) a manually-operable actuation device; (f) a display and a plurality of user-actuated controls; and (g) an induction coil located in the base portion; wherein the processing circuit is configured: (h) to perform data logging functions that involve multiple activations of the induction coil; (i) to automatically determine a fault condition when it occurs during operation of the induction heating apparatus; and (j) to identify a type of the fault condition and to show a message on the display indicating the type of fault condition.

In yet another embodiment, an induction heating apparatus is provided, which comprises: (a) a lower base portion; (b) a middle body portion; (c) a handle portion that is mechanically attached to a upper area of the body portion; (d) an electrical power supply and a controller, located in one of the body portion and the lower base portion, wherein the controller includes a processing circuit and a memory circuit; (e) a manually-operable actuation device; (f) a display, controlled by the processing circuit, and a plurality of user-actuated controls that send signals to the processing circuit; (g) at least one acoustic output device, controlled by the processing circuit; and (h) an induction coil located in the base portion; wherein the processing circuit is configured to: (i) receive a user command, by use of the plurality of user-actuated controls, as to whether the at least one acoustic output device is to produce one of: (A) a first audible signal having a first discernible characteristic upon an occurrence of a first predetermined event, and (B) a second audible signal having a second discernible characteristic upon an occurrence of the first predetermined event, wherein the second discernible characteristic is different than the first discernible characteristic.

In yet another embodiment, a method for heating anchor plates of a membrane roof, using at least two induction heating tools is provided, in which the method comprises the following steps: (a) providing a first induction heating tool that includes: (i) a first electrical power supply; (ii) a first controller, wherein the first controller includes a first processing circuit and a first memory circuit; (iii) a first manually-operable actuation device; (iv) a first user-actuated control that sends a first signal to the first processing circuit; (v) a first acoustic output device; and (vi) a first induction coil; (b) receiving a user command, by use of the first user-actuated control, instructing the first processing circuit to cause the first acoustic output device to produce a first audible signal having a first discernible characteristic upon an appropriate operating condition; (c) providing a second induction heating tool second that includes: (i) a second electrical power supply; (ii) a second controller, wherein the second controller includes a second processing circuit and a second memory circuit; (iii) a second manually-operable actuation device; (iv) a second user-actuated control that sends a second signal to the second processing circuit; (v) a second acoustic output device; and (vi) a second induction coil; (d) receiving a user command, by use of the second user-actuated control, instructing the second processing circuit to cause the second acoustic output device to produce a second audible signal having a second discernible characteristic upon an appropriate operating condition, wherein the second discernible characteristic is different than the first discernible characteristic; (e) with the first induction heating tool positioned at a first location on a roofing jobsite, energizing the first induction coil, upon activation of the first manually-operable actuation device by a user, to initiate a first heating activation cycle; (f) with the second induction heating tool positioned at a second location on the roofing jobsite, energizing the second induction coil, upon activation of the second manually-operable actuation device by a user, to initiate a second heating activation cycle, while the first induction heating tool is continuing its first heating activation cycle; (g) upon completion of the first heating activation cycle, causing the first acoustic output device to produce the first audible signal, thereby informing the user that the first heating activation cycle is complete, while the second induction heating tool is continuing its second heating activation cycle; and (h) upon completion of the second heating activation cycle, causing the second acoustic output device to produce the second audible signal, thereby informing the user that the second heating activation cycle is complete; thereby allowing the both the first induction heating tool and the second induction heating tool to be simultaneously used on a single roofing jobsite while providing the user with audible signals having different discernible characteristics to allow the user to distinguish between the operation of both of the first and second induction heating tools.

BRIEF DESCRIPTION OF THE DRAWINGS

Aspects of the disclosed embodiments will be described in reference to the Drawings, wherein like numerals reflect like elements.

DETAILED DESCRIPTION OF THE INVENTION

Reference will now be made in detail to a preferred embodiment, an example of which is illustrated in the accompanying drawings, wherein like numerals indicate the same elements throughout the views.

The terms "first" and "second" preceding an element name, e.g., first tone, second tone, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Figure 1:
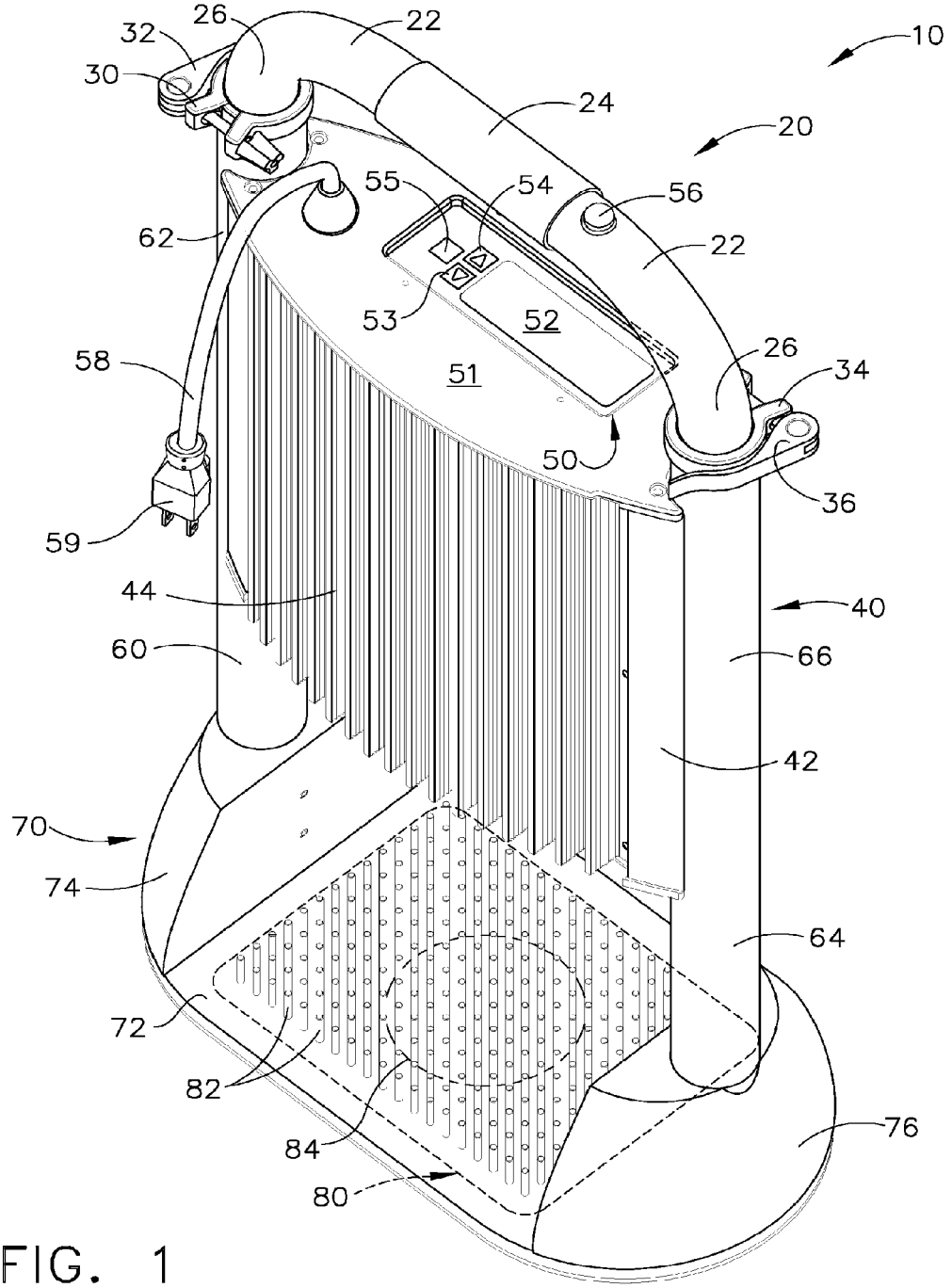
FIG. 1 is a perspective view from the rear of a portable induction heating tool used in membrane roofing applications, as constructed according to the principles of the present invention.
Figure 8:
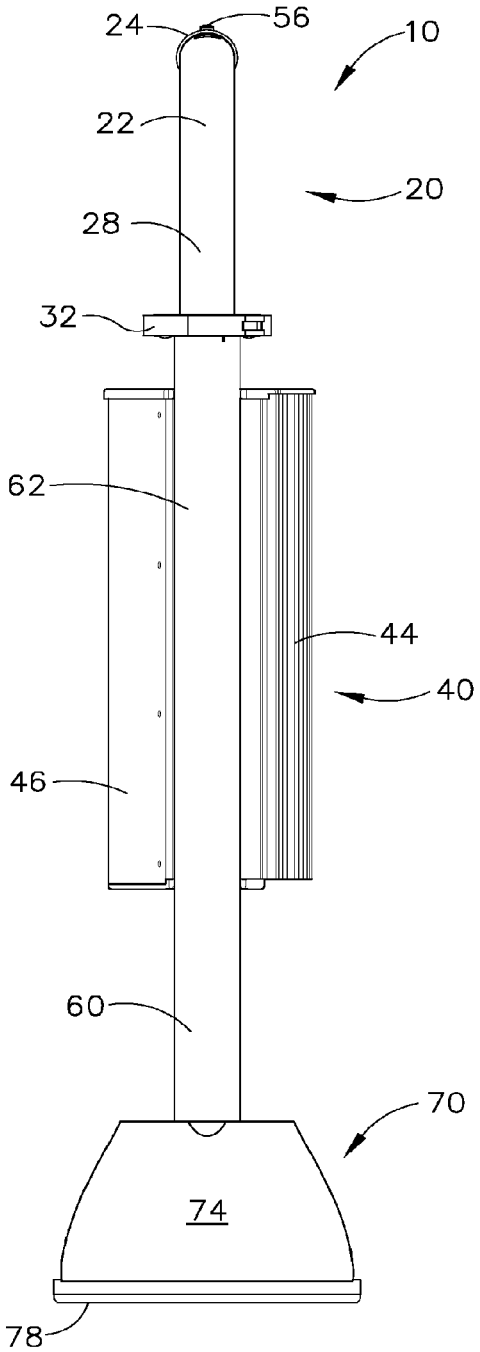
FIG. 8 is an elevation view from the right side of the tool of FIG. 1.

Referring now to FIG. 1, a portable induction heating tool is generally designated by the reference numeral 10, for use in heating anchor plates used in holding membrane roofs in position. Induction heating tool 10 has three major portions: a handle 20 (as an upper portion), a main body portion 40, and a base portion 70. The handle 20 includes an upper curved portion 22 that has a top gripable portion at 24. The handle 20 can be adjusted in length for ease of use by persons of different height. The two lowermost portions 26 of the handle 20 are depicted on FIG. 1 (and in other views) as being essentially vertical, where the lowermost portions 26 fit into a pair of vertical supports 62 and 66. The handle 20 can be extended, and one of those extensions is seen on FIG. 8, at the reference numeral 28.

Since the handle 20 has an adjustable length, the tool 10 has a pair of clamps 30 and 34 which are used to hold the handle 20 in position with respect to the vertical supports 62 and 66. The clamps 30 and 34 have pivotable cam arms 32 and 36 that can be released to adjust the height of the handle 20 with respect to the vertical supports 62 and 66. Once the user has moved the handle 20 to its proper height, the cam arms 32 and 36 can be tightened (i.e., pressed back against the clamps 30 and 34), thereby holding the vertical portions 26 (or 28) of the handle 20 in position with respect to the two vertical supports 62 and 66.

The central main body (or mid-portion) 40 of the tool 10 includes an outer housing 42 on one side that has a rather large array of heat sinks 44 at its mid-area that side of the mid-portion 40. On the opposite side of mid-portion 40 (see FIG. 2) the housing (or enclosure) depicted at reference numeral 46 is a solid sheet (with no individual heat sinks thereon). The system controller and power supply are inside the mid-portion 40, and these electrical components are generally designated by the reference numeral 48, which are not visible in the figures. The reason for this is that the internal housing for the mid-portion 40 is completely sealed, and the electrical and electronic components cannot be seen from the outside of an assembled housing of tool 10.

Figure 9:
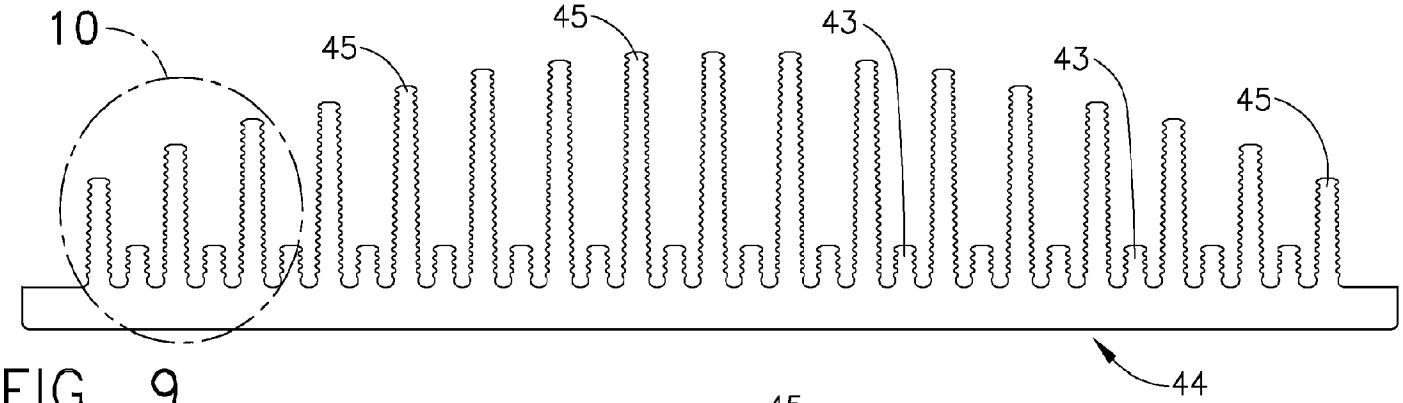
FIG. 9 is a cross-section view of the heat sink elements used in the tool of FIG. 1.
Figure 10:
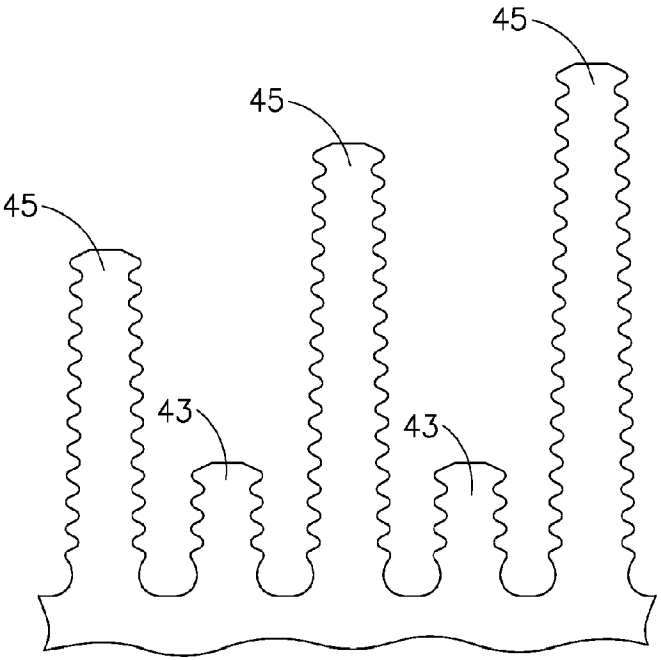
FIG. 10 is a magnified view of a portion of the heat sink elements of FIG. 9.

The electrical components 48 are cooled by the heat sink array 44, by making mechanical contact with those heat sinks, thereby allowing heat transfer to occur by conduction. (In other words, portions of the printed circuit board that holds the actual electrical components—including a casing that can surround a portion of the circuit board, if desired—can make physical contact with the base of the heat sink array 44, or can make contact with other heat conductive materials that will also make contact with the circuit board.) Further details of the heat sink structure are provided in FIGS. 9 and 10, in which the entire heat sink array is designated by reference numeral 44, which comprises multiple individual "fin" heat sinks 43 and 45. The shorter fin heat sinks are at 43, while the longer fin heat sinks are at 45. As can be seen in FIG. 9, the longer heat sinks 45 are not all of the same length, although any useful pattern of such heat sinks could be effectively utilized, without departing from the principles disclosed herein. As is apparent in FIG. 10, the example heat sinks 43 and 45 are corrugated, to provide a larger surface area for convective cooling with the ambient air.

Using the type of construction described above and in the drawings, the portable induction heating tool is designed to allow cooling air to reach the heat sinks 44, and those heat sinks are essentially directly coupled to the electrical components, using other heat-conductive structures. In this manner, the induction heating tool can be used in wet weather, if desired; or at least, the tool 10 can be stored outdoors. For example, while actual users may not desire to use the induction heating tool in a rain storm, they will be able to leave the induction heating tool 10 outside in bad weather, and will not have to shelter the tool 10 during such weather conditions. The "sealed" construction of the main body enclosure is essentially designed to deal with the harsh environment found on the roof of many buildings. Not only is there wet weather to contend with, but also dust, debris, tar, and other "messy" materials.

The central portion 40 has a control panel 50 along its top surface 51, and an alphanumeric display screen 52 is located where a user may easily see messages that are displayed on the screen 52. There are user control pushbuttons 53, 54, and 55 that are part of the control panel 50, and in FIG. 1 it can be seen that these control buttons 53-55 are positioned adjacent to the display screen 52. In general, the pushbuttons 53 and 54 are used to scroll through various menus that are displayed on the screen 52, and the pushbutton 55 is used to select or "enter" a particular control function once it has been displayed on the screen 52. The control buttons 53-55 may instead be flat-panel membrane switches, or another type of low profile switch contacts; they are also sometimes referred to herein as a "plurality of user-actuated controls."

A heating cycle activation pushbutton 56 is also part of the user controls of the heating tool 10. This pushbutton 56 could be located in many different places, including on the upper control panel surface 50, if desired. However, in the illustrated embodiment, this activation pushbutton 56 is located on the handle portion 20, at a place that will be easily accessible to a user of the induction heating tool 10. Pushbutton 56 is also sometimes referred to herein as a "manually-operable actuation device."

The induction heating tool 10 is electrically powered in the illustrated embodiment, and a power cord 58 is provided that enters the housing at the control panel surface 50. A plug 59 is provided at the end of the power cord 58. In the illustrated embodiment, the plug 59 is designed to interface into an electrical outlet or to an extension cord. For heating tools used in the United States and most North American geographic locations, the tool 10 will be powered by 120 volt AC line voltage. For European applications, the typical European A.C. voltage could be used instead, and the induction heating tool 10 will be provided with an appropriate power supply for the standard European voltage and frequency.

The middle portion of the induction heating tool 10 includes two vertical supports 62 and 66, as noted above. These supports extend further down at portions 60 and 64, respectively, which mechanically connect the upper and middle portions of the tool 10 to the base portion 70.

Figure 6:
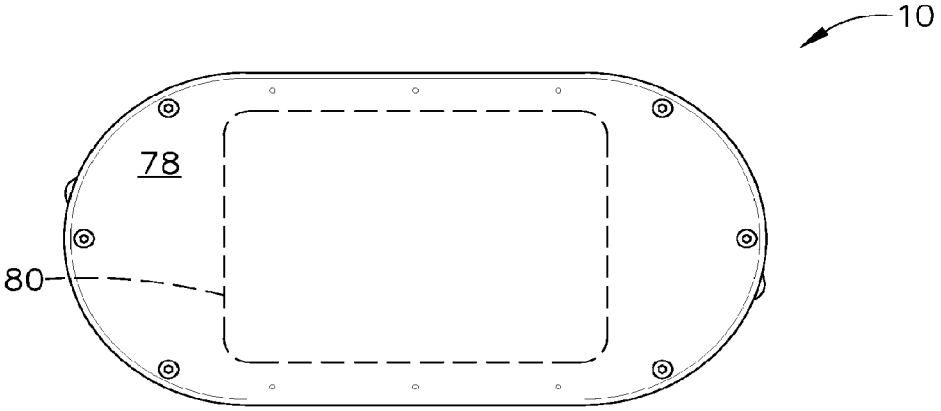
FIG. 6 is a bottom plan view of the tool of FIG. 1.
Figure 7:
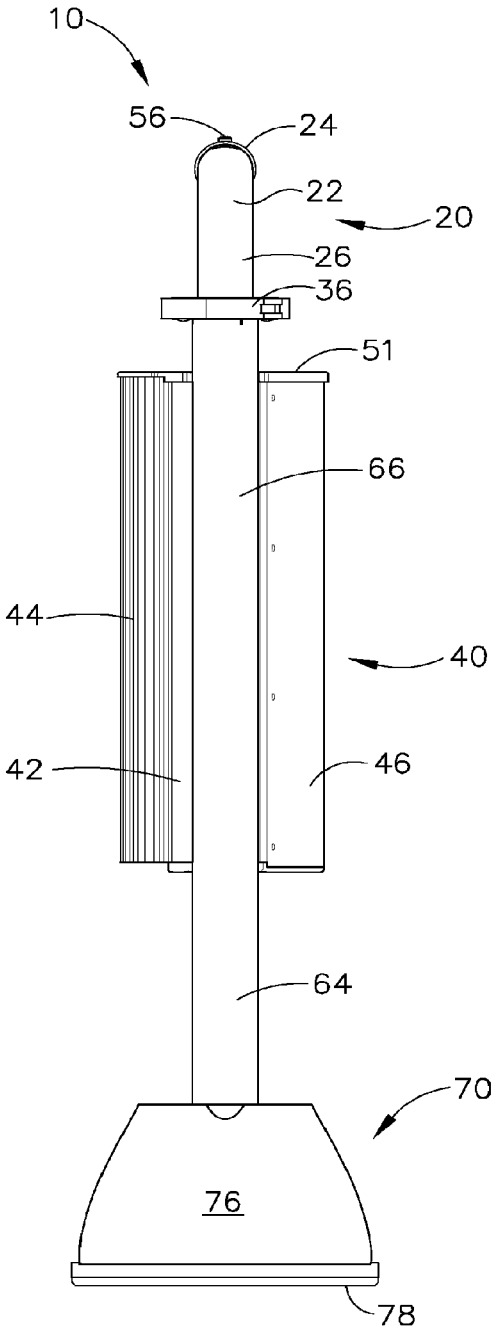
FIG. 7 is an elevation view from the left side of the tool of FIG. 1.

Base portion 70 has a bottom-most relatively flat (or planar) surface 78 (see FIG. 6). Base portion 70 contains an induction heating coil 80 (which is beneath the upper surface 72 of this bottom-most planar portion of the base 70). There are two vertical support members 74 and 76 which act as stand-offs and as mechanical protection for the middle area of the bottom member 72, in which these members 74 and 76 protect the induction heating coil 80. These two stand-off members 74 and 76 mechanically connect to the bottom-most portions of the vertical supports 60 and 64.

The induction heating coil 80 tends to become hot when in use, and there are multiple heat sinks 82 that are provided on the upper surface of the base portion 72. In the illustrated embodiment, these heat sinks 82 are small pin-type heat sinks (although other types of heat sinks could be used instead). Heat sinks 82 are located very close to the induction heating coil 80, and as such, allow for a substantial amount of cooling of the induction heating coil, without any moving parts. This same principle of operation is also used in the middle portion 40, in which the multiple heat sink elements 43 and 45 are located proximal to the electrical components of the power supply 48, which provide a substantial cooling effect without any moving parts. In other words, the induction heating tool 10 has no fans or liquid cooling tubes (which are found in many conventional portable induction heaters). The pin-type heat sinks 82 of the illustrated embodiment are mounted on a substrate that is made of a dielectric material, so that this substrate can be in direct contact with the induction heating coil 80. This allows the heat sinks 82 of the heat sink subassembly to be physically very close to the induction coil 80, so that thermal energy can be effectively conducted away from the induction coil by the multiple heat sinks 82. In illustrated embodiment, the heat sink substrate is made of a glass-filled epoxy material.

Since the substrate of the heat sink subassembly is made of a dielectric material, it will not be raised in temperature due to any magnetic field effects that would otherwise be caused by the magnetic field emitted by the induction coil 80. The relatively small pin-type heat sinks 82 are also designed so that they will undergo very minimal heating from the magnetic field of the induction coil. In this manner, the heat sink subassembly mounted to the base portion 70 will effectively transfer heat from the induction coil 80, but at the same time not be affected to any major extent by the magnetic field emitted by induction coil 80.

The induction heating tool 10 is designed to bond single ply membrane roofing to coated steel anchor plates, in which the anchor plates are coated with a heat-activated adhesive that will affix the membrane layer to the steel anchor plates when the anchor plates themselves are raised in temperature by the magnetic field produced by the coil 80 of the induction heating tool 10. The heating tool 10 is designed so that it can be used by a person standing at all times. The handle 20 can be picked up by a human hand, probably at the middle gripable portion 24, and lifted from one position to another on top of the membrane surface that is being applied to a roof.

An optional feature of the induction heating tool 10 is to include a target area (a fairly large circular area) 84 on the upper surface 72 of the base portion 70. This target area can be of a particular color, such as a large red circle; moreover it can be of a relatively large size, approximating the circular area of one of the steel anchor plates that are to be heated by the tool 10. Furthermore, optionally the target area 84 can be painted on not only the surface 72, but also on the pin heat sink elements 82 that happen to be positioned within the circular area of the target's arcuate outer (circular) edges. The use of such a target area will assist the user of the tool 10 in the proper placement of the base portion 70 over one of the circular anchor plates. It is somewhat surprising that such a simple "decoration" can be useful in this manner, but it actually provides an advantage to the user, and it is quite easy to take this advantage on a jobsite, as a visual aid.

The base portion 70 of tool 10 has a rather large predetermined footprint area (at its surface 78) so that the tool 10 will be stable, and can be left standing on a low slope roof. For example, the induction heating tool 10 is designed with a low center of gravity so that it can be used on an angled roof having a slope or grade as much as 2 parts in 12 (a 16.7% slope) which is a roof pitch angle of about 9.5 degrees.

Since the height of the handle 20 can be adjusted, the heating tool 10 can be used by human beings of various heights, and can simply be picked up from one location and lifted to another location on the roof where it is placed over one of the anchor plates that will then be bonded to the membrane layer of the roofing material. The user will push the activation switch 56 and can walk away from that location while the heating tool 10 automatically energizes its induction coil 80 for the proper amount of time to correctly heat the steel anchor plate, thereby raising the temperature of the heat-activated adhesive (without burning that adhesive), and sufficiently heating it so that the adhesive melts and adheres to the bottom surface of the single ply membrane layer. Tool 10 can also be used with multi-ply membrane roofing materials, if desired.

The induction heating tool 10 has an adjustable energy setting, so that the user can control how much energy will be emitted by the magnetic field produced by the induction coil 80, over an activation cycle. This will allow the heating tool 10 to operate on roofs at different ambient temperatures, without either overheating or underheating the steel anchor plates with respect to the appropriate amount of heating required to activate the adhesive coating of the anchor plate. The control circuit 210 (see FIG. 13) is capable of automatically selecting the power level at which the coil 80 will be driven, and is also capable of automatically determining when the heating (activation) cycle has been completed, based upon this user setting of the adjustable energy setting for the anchor plates of this jobsite. These automatic control capabilities are disclosed in an earlier patent document, also assigned to Nexicor LLC, namely U.S. Pat. No. 6,509,555.

In a preferred embodiment, the user will have ten different incremental adjustments that can be selected using the push-button controls 53-55. The appropriate information will be displayed on the display screen 52, so the user can see which of the ten available settings is being selected (or has previously been selected). The user can merely press the activation button 56 once the unit has been placed in the proper position over one of the anchor plates, and the user can then walk away to perform another task.

In a preferred mode, a single user can use two individual induction heating tools 10 on the same roof. Each heating tool is provided with an acoustic output device that provides the user with information as to when a heating activation cycle has started and when that cycle has completed. With two different induction heating tools on the same roof, the user can select one of the tools to use a first audible tone (i.e., selecting a first frequency for the first acoustic output device on the first tool), and for the second heating tool on the same roof, the user can select a second audible tone (i.e., a different audible frequency) for its second acoustic output device on the second tool. In that manner, the user can use two different induction heating tools simultaneously, and the user will know which tool is currently operating in a heating cycle, and will be able to tell which of the tools has completed a heating cycle, merely from listening to the audible sounds produced by the tools themselves.

The different audible tones are referred to herein as "TONE A" and "TONE B." TONE A stands for a first audible frequency, while TONE B stands for a second audible frequency. Each of these audible frequencies can be sounded as a single "beep" or it can be sounded in multiple beeps, which would have a different meaning. For example, a first induction tool 10 that is set to TONE A can output a single beep upon activation of a heating cycle, and can have two beeps sound at the end of that activation (heating) cycle. If a fault occurs, then that same tool can sound three beeps, or possibly more beeps at a faster interval, as selected by the system designer. However, each of these beeps could be at the same audible frequency. Therefore, these tone sequences will be referred to as "TONE A1" for the beginning of the activation cycle, "TONE A2" for the dual beeps that occur at the end of an activation cycle, and "TONE A3" for the multiple beeps that occur upon a fault condition during an activation cycle. These three audible sounds TONE A1, TONE A2, and TONE A3 could all output acoustic energy at the same audible frequency.

If a second induction heating tool 10 is set up to emit the "other" audible frequency, then the activation beep will be referred to as "TONE B1," the end of the activation cycle will be two beeps that will be referred to as "TONE B2," and a fault condition that causes multiple beeps at that same "other" frequency will be referred to herein as "TONE B3." By using the tones in the manner described above, the audible frequency acoustic output device can be a relatively inexpensive device, yet can provide at least six forms of information using two different individual heating tools 10, used on the same roof. The human user will be able to easily understand what each of these audible indications means, and can operate both tools simultaneously at two different locations on the same roof. In this manner, the user will be able to inductively heat the coated steel anchor plates very quickly, and seal the membrane roof in a very efficient manner.

It will be understood that the acoustic output device for tool 10 could actually be either a single device, or two separate devices. If a single device, such as a speaker 234 (on FIG. 13), then the CPU 220 can provide a drive signal at 235 to cause the speaker to produce audible tones at either of the two audible frequencies (for TONE A2 or for TONE B2, for example). The drive signal may pass through an audio power drive circuit, as necessary to properly drive speaker 234.

If the acoustic output device instead comprises two separate sound wave-producing devices, the first one (at reference numeral 230) would be for outputting at the first audible frequency, and the other one (at reference numeral 232) would be for outputting at the second audible frequency. The first acoustic output device 230 is driven by a signal 231, while the second acoustic output device 232 is driven by a signal 233. The signals 231 or 233 could themselves AC electrical signals that exhibit the first and second audible frequencies (e.g., as audible signals), or they could be logic signals that cause the two individual sound wave-producing devices 230 and 232 to become energized, and thereby operate in a mode by which they produce their respective audible output frequencies.

It will be understood that users may operate two separate heating tools in which the sound wave-producing devices for both tools would emit the exact same audible frequency, if desired. For example, the first tool on a particular roofing jobsite could emit "short" beeps at a frequency #1, while the second heating tool on the same roof jobsite could be emitting "long" beeps substantially at the same frequency #1. At first, it may be somewhat more difficult for the user to understand which tool is emitting the beeps, but with a short amount of practice, the user would quickly understand that the short beeps are coming from the first tool while the long beeps are coming from the second tool. The pattern of beeps could still be the same, i.e., a single long or short beep would have the same meaning for the two different tools (e.g., at the beginning of an activation cycle). Dual beeps could occur for both tools at the end of an activation cycle, if desired, and the dual beeps would be two short beeps for the first tool and two long beeps for the second tool, and so on.

In a further embodiment, the two separate tools could be using substantially the same audible frequency, in which one of the tools emits "steady" tones while the second tool emits "warbling" tones. The methodology for creating a warbling tone could be left up to the system designer, and it could be a true warble, in which the frequency of the tone is actually changed to a certain degree, which would certainly have a distinct sound. As another alternative, the warbling sound could be composed of tones that are always at the same exact frequency, but are produced in short intermittent bursts of acoustic output power, such as what would be produced if a square wave (perhaps with a duty cycle less than 100%) was used; this signal would create a distorted sound as compared to a "steady" tone having the waveform of a sine wave. Again, these sounds might require some "getting used to" by a user, but, with a short amount of practice, it would not be very long before the user would understand which tool was emitting the sounds.

In other words, various different sound patterns at the same audible frequency for two different tools on the same roof jobsite can be used, instead of different frequencies of tones, all without departing from the principles disclosed herein. Another way of stating this overall principle is that the first tool has an acoustic output device that produces a first audible signal having a first discernible characteristic that is sounded upon the occurrence of a first predetermined event; and the tool has an acoustic output device that (if commanded by a user) produces a second audible signal having a second discernible characteristic that is sounded upon the occurrence of the same first predetermined event, in which the second discernible characteristic is different than the first discernible characteristic.

In yet another embodiment, induction heating tool #1 could produce a music chord, such as a major fifth chord (e.g., C, E, G) or a minor fifth chord (e.g., C, E-flat, G), while induction heating tool #2 emits only a single note. This certainly would allow a user to easily discern the individual operation of both tools, while on the same roof jobsite.

Figure 11:
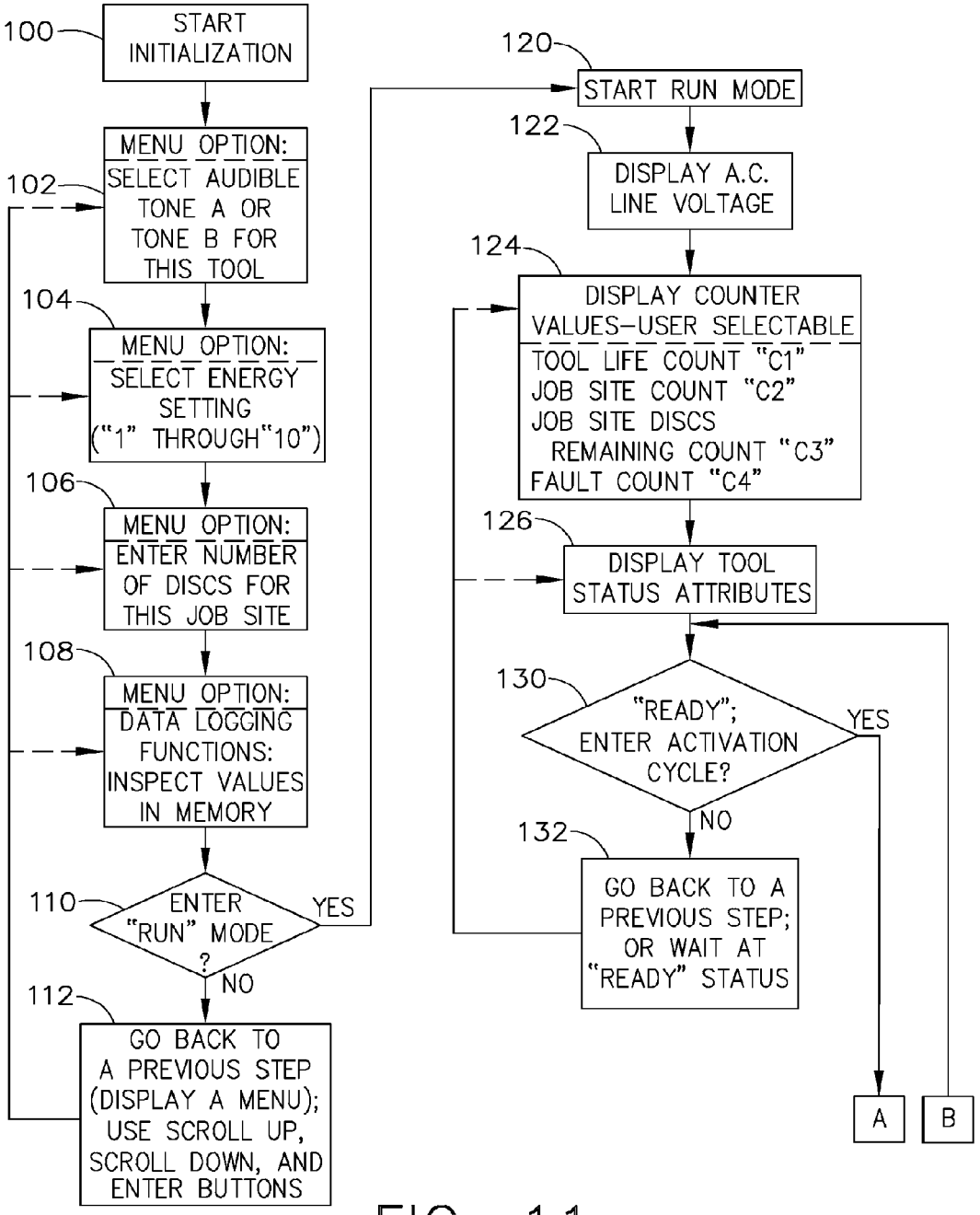
FIG. 11 is the beginning of a flow chart showing logic steps used in the tool of FIG. 1.

Referring now to FIG. 11, a logic flow chart is provided that shows some of the important steps in the operation of the disclosed induction heating tool. Starting at a step 100, the logic circuitry of the tool 10 is initialized. This would occur when the tool 10 is first turned on, which can occur by pressing a switch (such as the pushbutton switch 55), or it can be allowed to automatically reset when power is first applied at the line cord 58.

After the beginning of the initialization routine, an optional step 102 allows the user to select which audible tone will be used for this particular tool. As described above, a first audible frequency will be referred to herein as "TONE A," and a second audible frequency will be referred to herein as "TONE B."

An optional step 104 allows the user to select which energy setting is to be used for the particular jobsite. The energy setting can take into effect the ambient temperature at the roof, as of when the user is actually going to use induction tool 10 to seal a membrane roof to its anchor plates. In a preferred mode of operation, the user has ten (10) different settings for selecting the energy level at which the tool will be used. On the display screen 52, the user will have a menu of choices and can scroll up or down using the pushbuttons 53 and 54. When the user has selected the energy setting that is desired, the user can depress the pushbutton 55, and that energy setting will be used for the next run of heating events by operating tool 10.

Another optional step 106 allows the user to enter the number of discs that are going to be used on this particular jobsite. The number of discs is determined by the roof size and the density of anchor plates that are to be used for a particular membrane roof. If, for example the roof is rectangular, and there would be twenty (20) discs in one direction (along one edge of the roof), and thirty (30) discs along the other direction (along the other edge of the roof), then there would be six hundred (600) total discs for this roof. That is the number the user would now enter at step 106, which can be selected using the user pushbuttons 53-55. Note that this user setting typically would occur only once for a particular roof jobsite.

Yet another optional step 108 will allow the user to perform data logging functions, if desired. At this step, the user can inspect values stored in a memory circuit used with the processing circuit of the electronic controller 48. Some of the information stored in memory can include the number of activations of this induction heating tool 10 throughout its lifetime, the number of discs that have already been "sealed" on this particular jobsite, the number of discs that remain to be sealed on this jobsite, and also the number of "faults" that have occurred on this jobsite. In addition, the data log can also store in memory other important information, such as the time and date of when the energy setting has been changed, and to what new value (i.e., the values between one and ten) for the energy setting.

Other information can also be stored, such as the time and date for beginning the sealing of a particular roof (or jobsite), and also the time and date when the job ends for sealing a particular roof (or jobsite). In addition, the data log can also be programmed to contain the time and date of particular faults, as well as the type of fault. Many of the faults used with the tool are not errors or problems with the equipment itself, but instead are operational errors in which the user did not properly center the tool 10 over a particular anchor plate. As is understood in the roofing industry, the induction heating tool 10 must be properly centered over an anchor plate, or that plate will not be properly heated and therefore its adhesive coating will not properly adhere to the bottom of the membrane ply of the membrane roofing material. While a triple racetrack coil preferably is used for the induction coil 80 (as is disclosed in detail in U.S. patent application Ser. No. 11/507,131), and this coil configuration has important improvements with regard to the tolerance of positioning the tool over an anchor plate, the user nevertheless must place the tool 10 within the proper tolerance of the center of an individual anchor plate to be effectively heated.

In the vocabulary of this type of tool, an "underload" means that not enough metal was found when the tool was activated. This would occur if the user placed the tool at a distance that was too great from the center of a particular (or "target) anchor plate. On the other hand, an "overload" would be too much metal was found. This would occur if a user activated the tool at an improper location, such as on top of a steel plate or on top of several anchored discs that were somehow improperly positioned beneath a membrane ply. Of course, an overload condition should not occur under normal circumstances, but the induction heating tool 10 will automatically prevent damage to itself when an overload condition is encountered, by automatically refusing to operate for any appreciable length of time under those circumstances.

The induction heating tool is designed to automatically recover from either an underload or an overload condition, and can be quickly re-positioned and used again to heat an anchor plate when the induction heating tool 10 is placed at a proper location with respect to that anchor plate. However, the data log will store such a fault condition, and if desired, a time and date stamp can be maintained along with that type of fault condition. On the other hand, this might be too much information for a particular roofing contractor, and only the fact that an underload or overload type of fault occurred might be stored in memory, rather than also including the actual time and date stamp of that occurrence. This could be a user setting, or the designer of tool 10 might make this determination.

By automatically keeping track of the number of faults and the number of activations, the induction heating tool can automatically track the number of anchor plates that were "properly" heated for a particular jobsite. In this manner, the tool 10 can keep a running total of the number of discs that have been properly heated, as well as the number of discs that remain to be heated for a particular jobsite. In this manner, the user cannot "fool" the heating tool, since the number of discs being (properly and improperly) heated will be automatically stored in memory.

The data logging functions can be refined so as to store only selected information, as defined either by the user's supervisor on the jobsite, or by the designer of the induction heating tool. As noted above, for example, the if the type of fault that occurs is either and overload or an underload event, then it may be more efficient use of memory to not store the time and date of such events in the data log. In other words, such operational "errors" may occur frequently enough that it is not deemed necessary to know exactly when each such event actually has occurred. Instead, the mere knowledge that there have been a relatively large number of such events may be an indication that the tool operator (i.e., the "user") is not correctly using the tool in many situations, and further training of the tool operator might be recommended.

As an alternative data logging routine, the tool 10 could store the number of overload and underload events, without storing the exact time and date of such events, as suggested in the previous paragraph. However, it might be useful to store the number of overload/underload events per day, so that the data log provides a history of the tool's usage that can later be inspected to determine whether or not the tool was "properly" used (and by whom) on a particular day. Again, this could be an indication that further training is needed for a particular tool operator, and this "fault" log information would not necessarily need to be inspected at the end of each working day.

A decision step 110 now asks the user if he or she is ready to enter the "run" mode of operation. If not, a step 112 will allow the user to go back to a previous step by displaying a menu. The user can use the scroll pushbuttons 53 and 54 to select which of the displays will be brought up on the screen 52, so the user can make other selections, as desired. If the user is ready to enter the run mode at step 110, a step 120 begins the run mode of operation. A step 122 displays the AC line voltage on the screen 52. In a preferred embodiment, the line voltage can be displayed at all times once the run mode has been entered. This will allow the user to instantly know whether or not there has been some detrimental occurrence in the line voltage, which typically would be due to a problem with the field electrical generator that is used on top of most roofing jobsites.

It should be noted that the optional steps 102, 104, 106, and 108 can be bypassed by the user, and the user can "jump" directly to the run mode at step 110, after initialization. On the other hand, if the user desires to perform one of the optional functions that are listed at any of the steps 102, 104, 106, or 108, then the computer software of the can be designed to allow the user to easily "navigate" through the displayed menu choices to any one of those optional functions. For example, in a preferred embodiment, the functions of step 112 (to "go to" one of the steps 102, 104, 106, or 108) can be used at any time the induction heating tool 10 is not in the "ready" mode of operation, which is the activation cycle. This feature allows the user to be able to quickly move to a desired "optional" function at any time the tool 10 is not in its ready (activation) mode. However, for the sake of clarity, the flow chart of FIG. 11 does not show every single possible logic flow path between each of the logic steps that can actually be utilized in the induction heating tool 10.

A step 124 allows the user to display counter values, as selected by the user. The tool life count value can be displayed, referred to herein as count value "C1." This count value is not allowed to be altered by a user, and tracks the total number of heating activations over the tool's life. Once the lifetime count value is reached (e.g., 100,000 cycles), a message can be displayed on screen 52, informing the user that it is time to have this tool refurbished. The jobsite count value is "C2" (representing the number of discs already properly heated), while the number of discs remaining to be heated on the jobsite is a count value "C3." The number of faults for this jobsite is referred to as count value "C4."

A step 126 can also display other status attributes of the tool, as selected by the user. These count values and other status attributes can be displayed on the screen 52 between activation cycles, as desired by the user. In addition, the "optional" steps 102, 104, 106, and 108 can be performed between activation cycles, as noted above.

A decision step 130 now asks the user if he or she is ready to enter an "activation cycle." If no, a step 132 allows the user to go back to a previous step, or merely to wait at a "ready" status. If the user is ready to activate, then the logic flow is directed to a box A, which takes the logic flow to FIG. 12.

Figure 12:
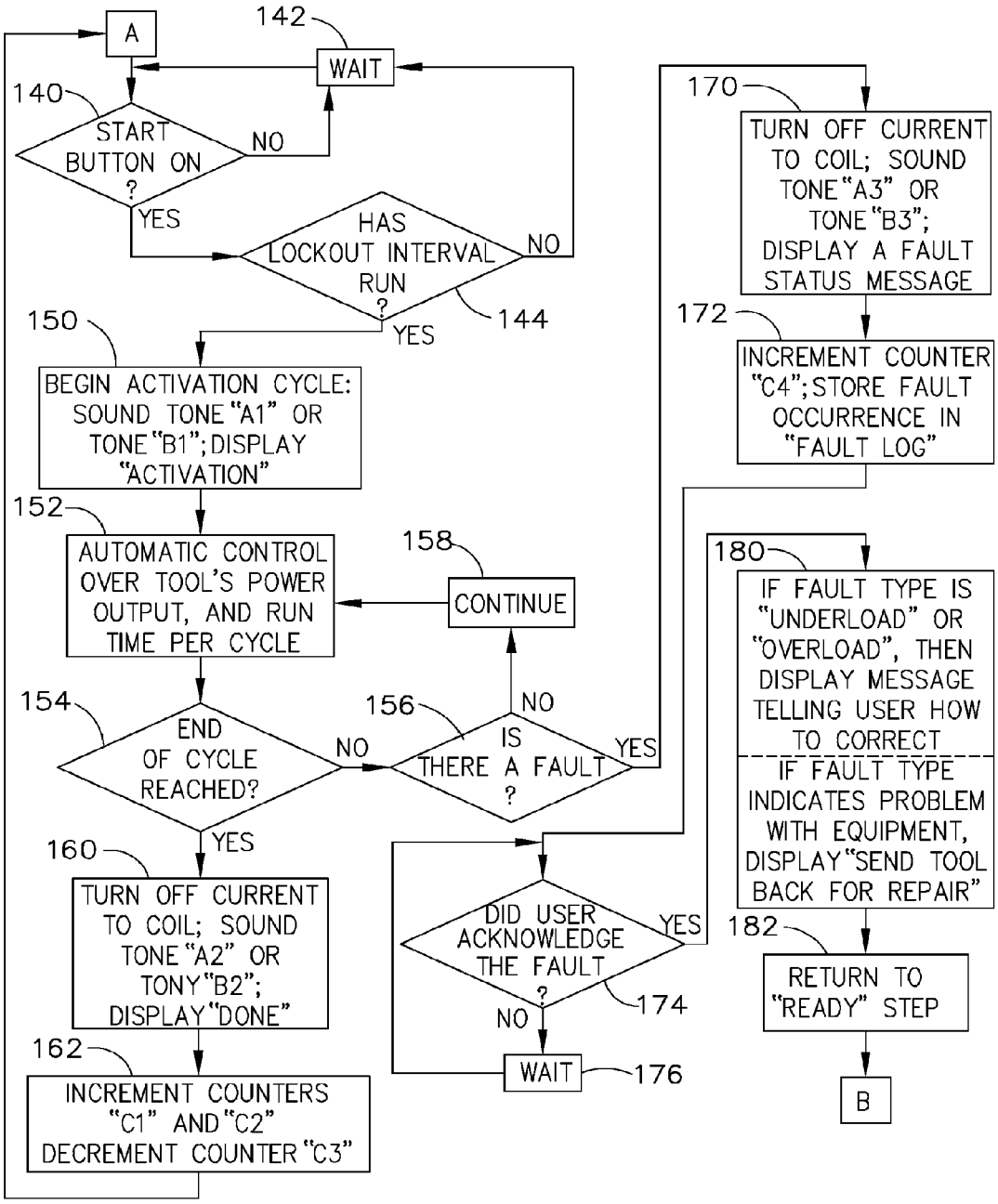
FIG. 12 is the second page of the flow chart showing further logic steps.

On FIG. 12, a decision step 140 determines whether or not the "start" button has been pressed. If no, then a step 142 waits for the user to press that button, which is pushbutton 56 on FIG. 1. Once the start button has been pressed, a decision step 144 determines whether or not a "lockout" time interval has expired. If not, the user must wait for a minimum time interval (such as three seconds), which occurs at the wait step 142. After the lockout interval has run, the logic flow will be allowed to continue to a step 150.

At step 150, the activation cycle begins. The tone "A1" or "B1" will be sounded, depending upon whether the user selected TONE A or TONE B at step 102. The display screen 52 will display the word "ACTIVATION." A step 152 now allows the automatic control system of the tool to control the power output and also will automatically control the run time per heating event. The run time is automatically controlled, and the control system knows what energy setting has been selected by the user, at step 104. Once the end of the heating cycle is reached, a decision step 154 will direct the logic flow to a step 160 and the current to the induction coil is turned off. On the other hand, if a fault occurs during the activation cycle, a decision step 156 will detect that event and send the logic flow to a step 170. If no fault occurs, the logic flow is directed to a "continue" step 158, at which time the logic flow continues through steps 152 and 154 until the end of the heating cycle has been reached.

At step 160, not only is the current to the coil turned off, but tone "A2" or "B2" is sounded, and the display screen 52 will show the word DONE. A step 162 now increments the counters C1 and C2, and decrements the counter C3. The logic flow now returns to Box A, waiting for the beginning of the next activation event.

If a fault has occurred, step 170 turns off the current to the induction coil, and sounds either tone "A3" or "B3," and also displays a fault status message on the screen 52. If the fault is either an underload or an overload, the user will be allowed to continue using the tool. If it is a different type of error, then the tool will likely need to be repaired, or at least inspected.

A step 172 increments the counter "C4," and the occurrence of the fault is stored in a "fault log" in memory of the tool. The user should acknowledge the fault before attempting to use the tool again. At a decision step 174, the operating logic determines whether the acknowledgement has occurred yet; if not, the tool "waits" at a step 176 until the user performs the required acknowledgement.

The tool 10 will now allow the user to continue operating the tool, although in some cases, the tool really should be repaired before operating again. If the fault type is either underload or overload, then there is nothing wrong with the tool itself, and a new activation cycle will be allowed to begin. At a step 180, a message is given on the display 52 to inform the user that the fault type was an "underload" or an "overload," and the display can also give instructions to the user as to how to avoid that situation.

On the other hand, if the type of fault indicates a problem with the equipment, then step 180 will give a different message on display 52, something like: "SEND TOOL BACK FOR REPAIR." As a design choice, the tool 10 could be automatically disabled. After the message has been displayed at step 180, the logic is directed to a step 182, and then it returns to the "ready" step 130 (on FIG. 11) via a box "B."

Figure 2:
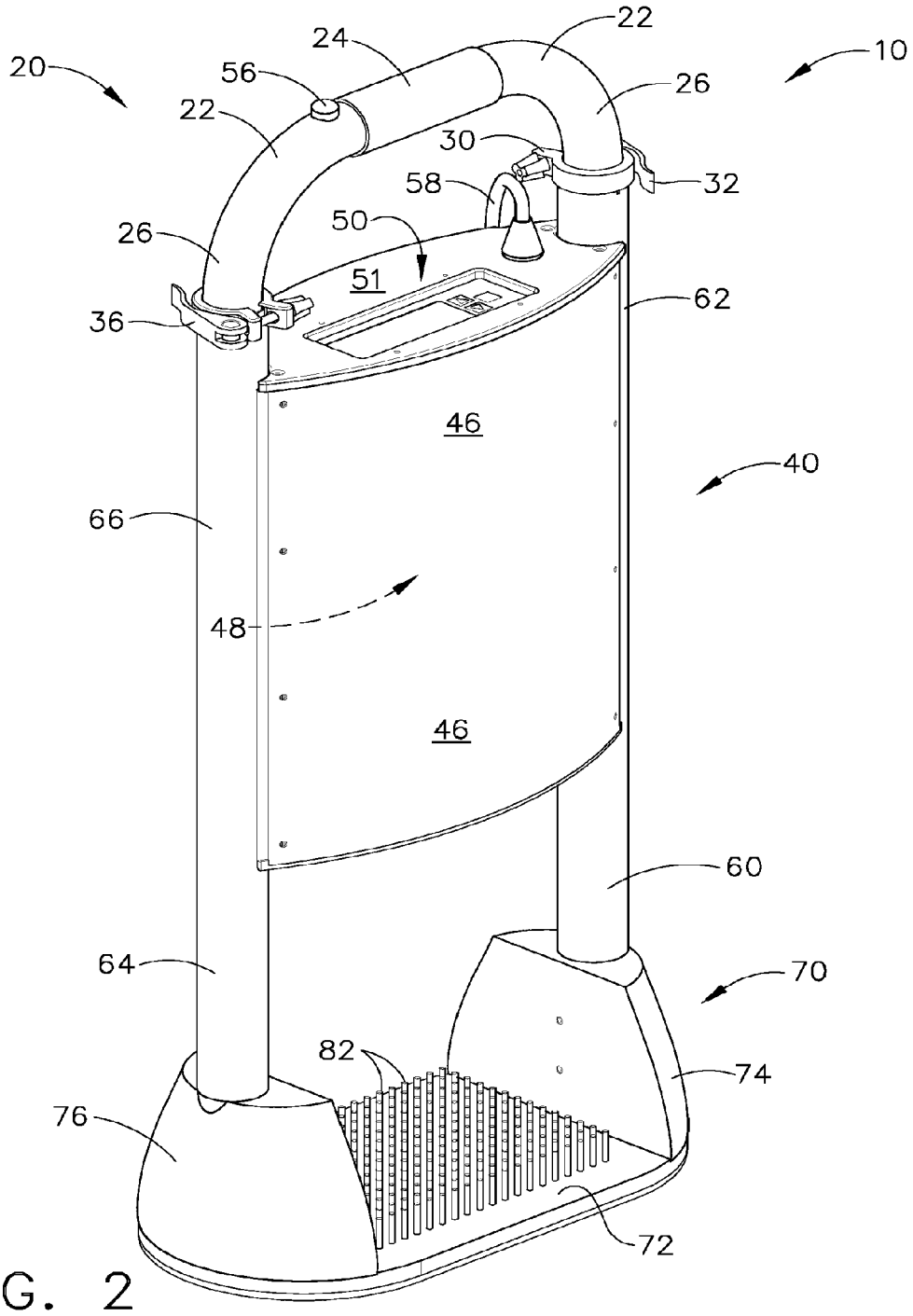
FIG. 2 is a perspective view from the front side of the tool of FIG. 1.
Figure 3:
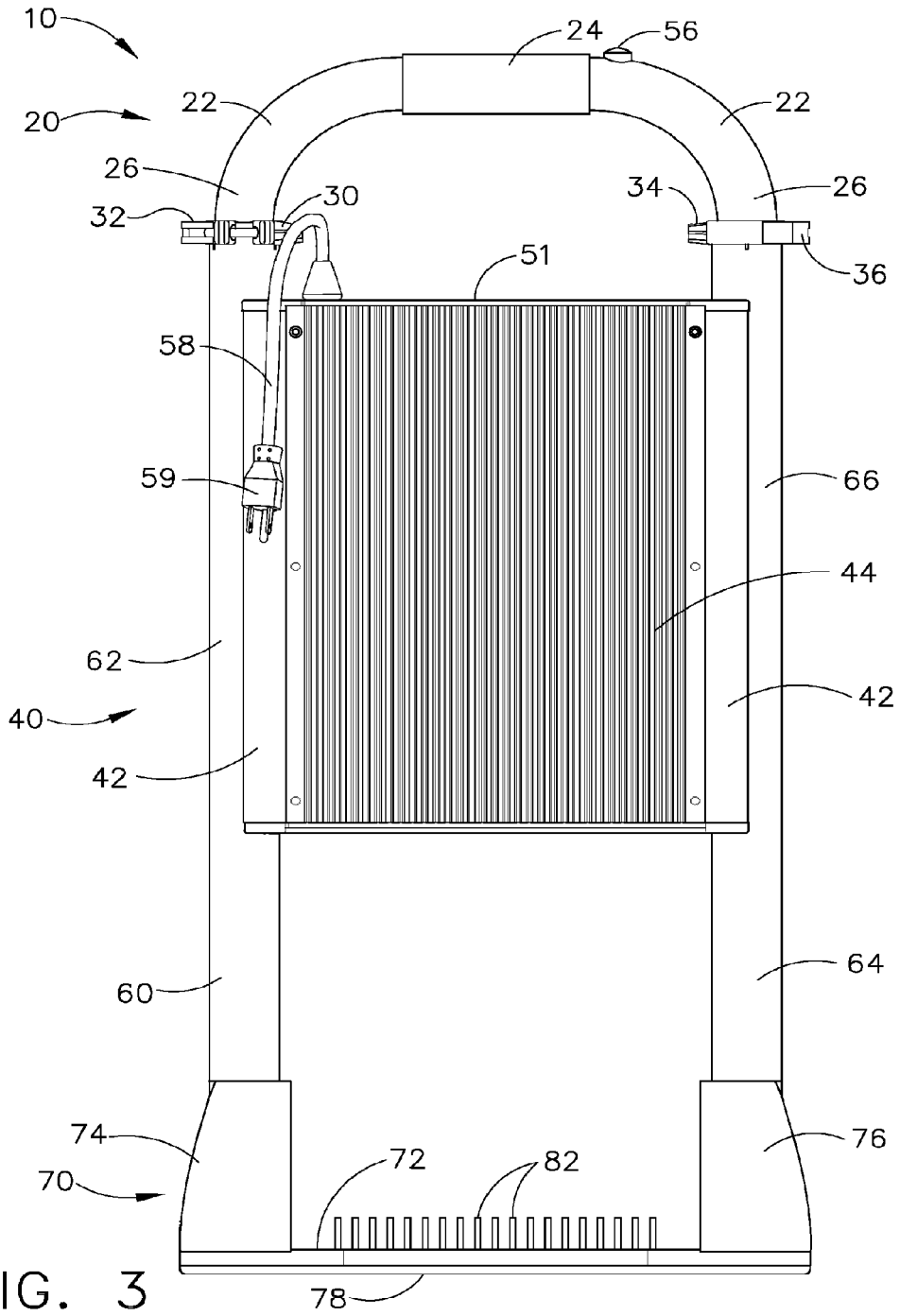
FIG. 3 is an elevation view of the rear of the tool of FIG. 1.
Figure 4:
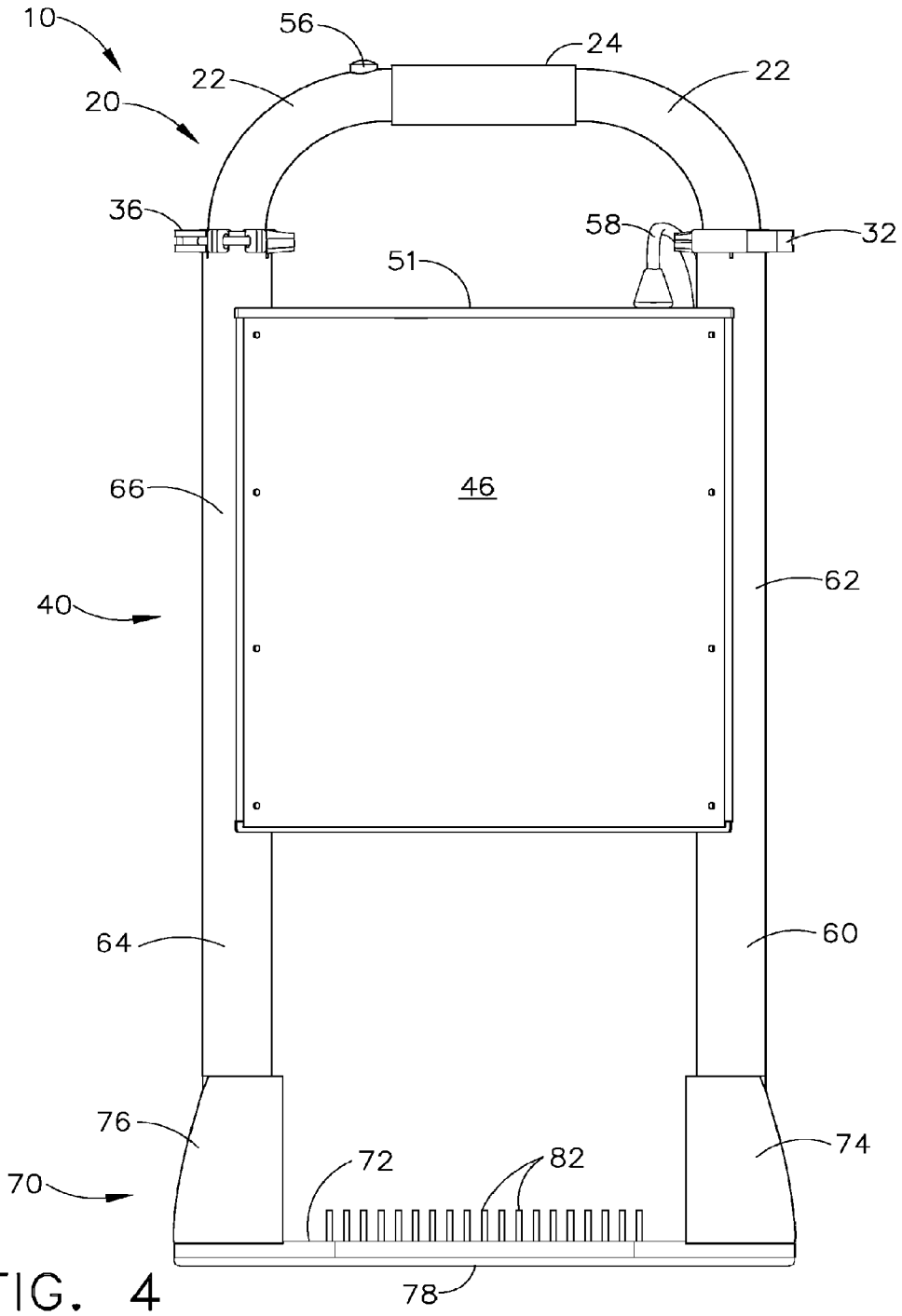
FIG. 4 is an elevation view of the front of the tool of FIG. 1.
Figure 5:
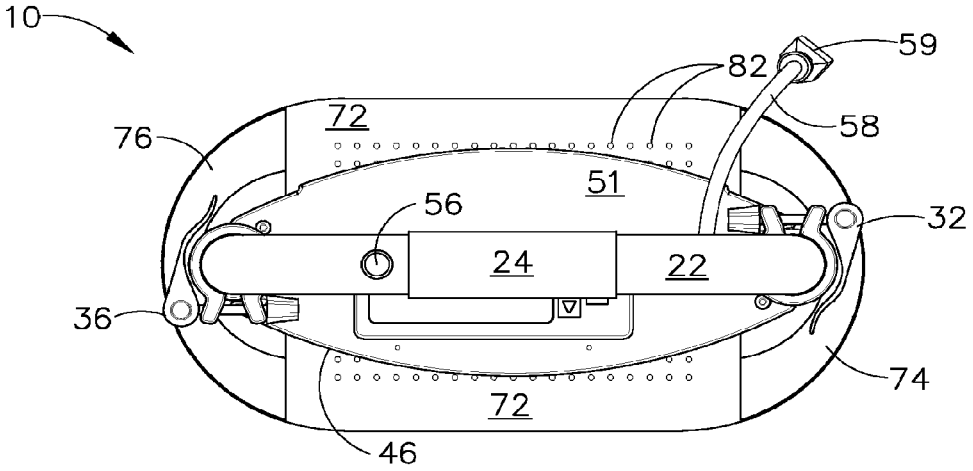
FIG. 5 is a top plan view of the tool of FIG. 1.
Figure 13:
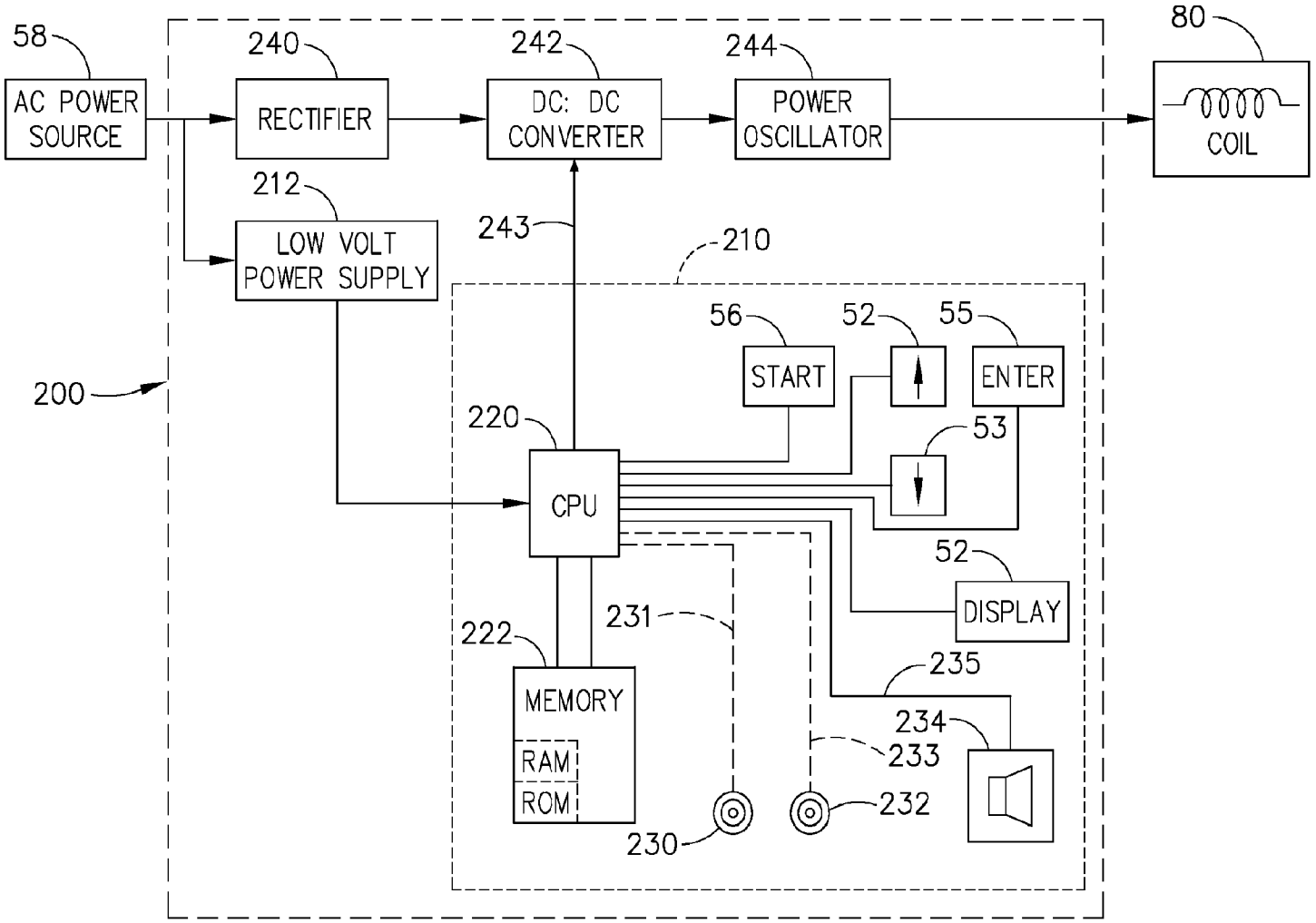
FIG. 13 is a block diagram of some of the electrical components of the controller for the tool of FIG. 1.

Referring now to FIG. 13, the induction heating tool 10 includes a system controller and power supplies, which are generally designated by the reference numeral 48 (see FIG. 2). FIG. 13 shows, in a diagrammatic view, some of the important "large" components of these electrical components at a reference numeral 200, including a logic control circuit 210. A low voltage power supply 212 provides DC voltages for the processing and memory circuit components of logic control circuit 210, in which a microprocessor (or "CPU") 220 is depicted with a memory circuit 222. Of course, a microcontroller could be used in lieu of both components 220 and 222, if desired, assuming the microcontroller had sufficient on-board memory capacity.

The user controls are depicted at 52, 53, 55, and 56; these are used as input devices to the CPU 220. With regard to output devices, the CPU controls the display 52, and the acoustic output devices 230 and 232. In an exemplary tool 10, the first acoustic output device 230 is to emit sound waves at a first audible frequency (e.g., at 800 Hertz), and is controlled by a signal at 231, from CPU 220; the second acoustic output device 232 is to emit sound waves at a second audible frequency (e.g., at 1,600 Hertz), and is controlled by a signal at 233, from CPU 220.

It will be understood that a single acoustic output device (acting as both 230 and 232) could be used to emit sound waves at both of the two audible frequencies used by tool 10, and the selection process at step 102 on the flow chart of FIG. 11 would control which audible frequency is to be used by that single device 230/232. This is a matter of design choice. If two separate acoustic output devices are used in a particular tool 10, then the flow chart step 102 would nevertheless be used to select which one of those devices 230 or 232 would be used for that particular tool for a specific project (which could be changed at a moment's notice by a user selection at step 102, between activation cycles).

The electrical components of tool 10 also require "high voltage" power components, so as to provide sufficient power to drive the induction coil 80. A relatively high voltage power supply is provided, starting with a rectifier circuit 240, which supplies power to a DC-to-DC converter 242. The DC: DC converter 242 supplies power to a power oscillator circuit 244, which directly drives the induction coil 80. The CPU 220 controls the power output setting of the inverter circuit 242, which in turn effectively controls the power settings of the power oscillator circuit 244 and coil driver circuit 246. It should be noted that the power setting of tool 10 is automatically controlled so as to properly activate (or "heat") the target anchor plate, which is a metal susceptor that creates eddy currents when exposed to a magnetic field (such as that produced by induction coil 80). The automatic control system is discussed in earlier patent documents by some of the same inventors, and assigned to Nexicor LLC.

Details of the types of circuit designs that can be used for the purposes discussed above are found in other co-owned U.S. patents and pending patent applications, including: U.S. Pat. No. 6,509,555, issued Jan. 23, 2003, titled: "HAND HELD INDUCTION TOOL;" U.S. Pat. No. 6,875,966 issued on Apr. 5, 2005, titled: "PORTABLE INDUCTION HEATING TOOL FOR SOLDERING PIPES;" U.S. patent application Ser. No. 11/093,767, filed on Mar. 30, 2005, titled: "METHOD AND APPARATUS FOR ATTACHING A MEMBRANE ROOF USING INDUCTION HEATING OF A SUSCEPTOR;" U.S. patent application Ser. No. 11/507,131, filed on Aug. 21, 2006, titled: "METHOD AND APPARATUS FOR ATTACHING A MEMBRANE ROOF USING AN ARM-HELD INDUCTION HEATING APPARATUS;" and U.S. design patent application Ser. No. 29/303,803, filed on Feb. 18, 2008, titled "PORTABLE INDUCTION HEATER."

An example of the above-noted triple racetrack coil design is disclosed in a co-pending, co-owned patent application, U.S. patent application Ser. No. 11/507,131, filed on Aug. 21, 2006, titled "METHOD AND APPARATUS FOR ATTACHING A MEMBRANE ROOF USING AN ARM-HELD INDUCTION HEATING APPARATUS." The above-cited patent documents are incorporated by reference herein in their entireties.

It will also be understood that the logical operations described in relation to the flow charts of FIGS. 11-12 can be implemented using sequential logic, such as by using microprocessor technology, or using a logic state machine, or perhaps by discrete logic; it even could be implemented using parallel processors. One preferred embodiment may use a microprocessor or microcontroller to execute software instructions that are stored in memory cells within an ASIC. In fact, the entire microprocessor (or microcontroller), along with RAM and executable ROM, may be contained within a single ASIC. Of course, other types of circuitry could be used to implement these logical operations depicted in the drawings without departing from the principles of disclosure.

It will be further understood that the precise logical operations depicted in the flow charts of FIGS. 11-12, and discussed above, could be somewhat modified to perform similar, although not exact, functions without departing from the principles of the disclosure. The exact nature of some of the decision steps and other commands in these flow charts are directed toward specific future models of induction heating tools and certainly similar, but somewhat different, steps would be taken for use with other models or brands of induction heating tools in many instances, with the overall inventive results being the same.

As used herein, the term "proximal" can have a meaning of closely positioning one physical object with a second physical object, such that the two objects are perhaps adjacent to one another, although it is not necessarily required that there be no third object positioned therebetween. Within the disclosed tool, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal." Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

All documents cited in the Background and in the Detailed Description are, in relevant part, incorporated herein by reference; the citation of any document is not to be construed as an admission that it is prior art with respect to the invention claimed.

While a preferred embodiment has been set forth for purposes of illustration, the foregoing description should not be deemed a limitation of the invention herein. Accordingly, various modifications, adaptations and alternatives may occur to one skilled in the art without departing from the spirit of the invention and scope of the claimed coverage.

What is claimed is:

1. An induction heating apparatus for initiating a series of heating cycles of activation followed by deactivation, comprising:

a lower base portion;

a middle body portion;

a power supply, coil driver circuit, and controller having a processing circuit, positioned within at least one of said body portion and said base portion; and an induction coil operatively connected to the power supply via the coil driver circuit for activation thereof, the induction coil positioned in said base portion; wherein said processing circuit is configured to log data for multiple cycles of activations of said induction coil and detect the occurrence of at least one predetermined fault condition during operation of the apparatus, and thereafter identify the type of fault condition detected.

2. The induction heating apparatus of claim 1, comprising a visible display operatively connected to the processing circuit, wherein the processing circuit initiates a visible change on the display indicating the type of fault condition detected.

3. The induction heating apparatus of claim 1, wherein the type of fault condition is selected from the group including an overload state wherein a level of metal above a predetermined level is detected, an underload state wherein a level of metal below a predetermined level is detected, and another error state.

4. The induction heating apparatus of claim 3, wherein if the error detected is an overload state or an underload stated, the display indicates the type of error and the apparatus is allowed to continue operating.

5. The induction heating apparatus of claim 1, comprising a memory circuit in operative communication with the processing circuit, wherein said processing circuit initiates storage in the memory circuit of a time, date and type of fault detected.

6. The induction heating apparatus of claim 1, comprising a plurality of user-actuated controls for sending signals to the processing circuit, wherein the processing circuit initiates tracking and storage of the number of proper heating cycles by the coil by incrementing each heating cycle that completes without detection of an error state while not incrementing each heading cycle that initiates detection of an error state.

7. The induction heating apparatus of claim 1, comprising a plurality of user-actuated controls for sending signals to the processing circuit, wherein a target number of proper heating cycles can be input via the controls and stored in memory circuit, and the processing circuit initiates tracking of the number of proper heating cycles by the coil by incrementing each heating cycle that completes without detection of an error state while not incrementing each heading cycle that initiates detection of an error state until the number of proper heating cycles incremented equals the target number, thereafter triggering an alert on the display.

8. The induction heating apparatus of claim 1, comprising at least one audio output in operable communication and controlled by said processing circuit, configured to produce a plurality of different audible sounds, wherein during operation of the apparatus to activate the induction coil, said processing circuit is configured to initiate a first audible signal from the at least one audio output upon detection of a first predetermined event, and optionally initiate a second audible signal from the at least one audio output upon detection of a second predetermined event that is different from the first predetermined event, wherein the first and second audible signals are different from each other.

9. The induction heating apparatus of claim 8, wherein the first predetermined event is one of the at least one predetermined fault condition.

10. The induction heating apparatus of claim 8, wherein the first and second predetermined events are each one of the at least one predetermined fault condition.

11. An induction heating apparatus for initiating a series of heating cycles of activation followed by deactivation, comprising:

a lower base portion;

a middle body portion;

a power supply, coil driver circuit, and controller having a processing circuit, positioned within at least one of said body portion and said base portion;

an induction coil operatively connected to the power supply via the coil driver circuit for activation thereof, the induction coil positioned in said base portion; and at least one audio output in operable communication and controlled by said processing circuit, configured to produce a plurality of different audible sounds;

wherein during operation of the apparatus to activate the induction coil, said processing circuit is configured to initiate a first audible signal from the at least one audio output upon detection of a first predetermined event, and optionally initiate a second audible signal from the at least one audio output upon detection of a second predetermined event that is different from the first predetermined event, wherein the first and second audible signals are different from each other.

12. The induction heating apparatus of claim 11, wherein the at least one audio output is a single device configured to generate a plurality of different audible signals having different frequencies.

13. The induction heating apparatus of claim 11, wherein the at least one audio output is a plurality of devices, each device in operable communication with the processing circuit and being configured to generate a single audible signal that are different from each other.

* * * * *